US005535720A

United States Patent [19]

Pantalleresco

[11] Patent Number: 5,535,720

[45] Date of Patent: Jul. 16, 1996

[54] INDUCTION SYSTEM

[76] Inventor: Andrew J. Pantalleresco, 9161 Lucerne, Redford, Mich. 48239

[21] Appl. No.: 510,609

[22] Filed: Aug. 3, 1995

[51] Int. Cl.[6] ..... F02D 7/00

[52] U.S. Cl. ..... 123/349; 123/363; 261/DIG. 36

[58] Field of Search ..... 123/349, 363, 123/376, 402, 403; 261/DIG. 36

[56] References Cited

U.S. PATENT DOCUMENTS

| | | | |
|---|---|---|---|
| 3,114,669 | 12/1963 | Herbst | 161/165 |
| 3,366,145 | 1/1968 | Lohn | 138/39 |
| 3,678,962 | 7/1972 | Pierce, Jr. | 138/39 |
| 3,721,309 | 3/1973 | Donaldson | 123/376 |
| 3,949,716 | 4/1976 | Liu | 123/332 |
| 3,968,779 | 7/1976 | Davis | 123/332 |
| 4,669,437 | 6/1987 | Shinno | 123/376 |
| 4,727,837 | 3/1988 | Sturdy | 123/361 |
| 4,961,409 | 10/1990 | Kobayashi et al. | 123/376 |
| 4,993,385 | 2/1991 | Miyamoto | 123/400 |
| 5,117,782 | 6/1992 | Bischoff et al. | 123/1 A |

*Primary Examiner*—David A. Okonsky
*Attorney, Agent, or Firm*—Joseph N. Breaux

[57] ABSTRACT

An induction system and method for enhancing the efficiency and performance of an internal combustion engine connectable between an air filter and an intake manifold of an internal combustion engine is provided. The induction system comprises: a governor having an adjustment mechanism, the governor connectable with the intake manifold; a governor guard having a top planar member and a guard member extending substantially vertically therefrom, the top planar member in connection with the governor, the guard member adapted for rigidly covering the adjusting mechanism of the governor; a carburetor in connection with the governor guard in a manner such that the carburetor is in fluid connection with the governor; a carburetor adapter forming a air passageway in connection between a first and second port, the first port in fluid connection with the carburetor; and an air intake hose forming a air passage in connection between an initial and terminal end opening, the initial end opening in fluid connection with the second port of the carburetor adapter, the terminal end opening being connectable to an air filter.

20 Claims, 1 Drawing Sheet

INDUCTION SYSTEM

TECHNICAL FIELD

The present invention relates to devices and methods for enhancing the efficiency and performance of internal combustion engines and more particularly to devices and methods for enhancing the efficiency and performance of internal combustion engines and that prevent governor tampering.

BACKGROUND ART

It is common to have vehicles which are design for specific uses. Often, these vehicles require the use of a governor to maintain engine speed within a specific operating range. These governors are often adjusted and tampered with to increase the speed of the vehicle. However, these adjustments to the governor result in inefficient fuel consumption, excessive engine wear and often to engine failure.

In the domestic and international airline industry 300 cubic inch Ford/Clark engines are used extensively in baggage tow tractors. These tractors commonly have a seventeen to one rear end ratio which requires a governor to prevent the engine from running at excessive revolutions per minute. However, it is common practice for the tractor operators to tamper with the governors resulting in excessive engine and transmission failure.

These engines are conventionally equipped with a single barrel, manual choke carburetor. On cold days and nights these chokes are often engaged and left open resulting in fuel dumping and fouling of the spark plugs.

It would be a benefit, therefore, to have an induction system which incorporates an automatic choke carburetor. It would be a further benefit to have an induction system which includes a governor to prevent excessive engine failure. It would be a further benefit to have an induction system which prevents tampering and unauthorized adjustment of the governor setting.

GENERAL SUMMARY DISCUSSION OF INVENTION

It is thus an object of the invention to provide an induction system that incorporates an automatic choke carburetor.

It is a further object of the invention to provide an induction system that includes a governor to prevent excessive engine wear and failures.

It is a still further object of the invention to provide an induction system that prevents tampering and unauthorized adjustment of the governor setting.

Accordingly, an induction system for enhancing the efficiency and performance of an internal combustion engine connectable between an air filter and an intake manifold of an internal combustion engine is provided. The induction system comprises: a governor, a governor guard, a carburetor, a carburetor adapter and an air intake hose.

The induction system of the present invention may be constructed as a unitary unit. In a preferred embodiment, externally thread studs or bolts extend vertically from the intake manifold of an engine for connection of the induction system. The bolts may have various sized threads along their length. The bolts may have coarse threads extending along the top half and finer threads along their bottom half. Only a top portion of the bolts may be threaded.

The governor has an adjustment mechanism exposed through a side for controlling the operating range of the governor. The governor is sealingly connected to the intake manifold. A governor guard is connected atop the governor. The governor guard has a guard member which covers the governor adjusting mechanism preventing access without dismantling the induction system. The governor guard forms a fluid passage way to allow for a fluid connection between the carburetor and the governor.

A carburetor is sealingly connected atop the governor guard and is in fluid connection with the governor and the intake manifold. Preferably, the carburetor has an automatic choke. A spacer is connected between the carburetor and a carburetor adapter. The spacer allows the choke linkage to move freely without binding. The carburetor adapter is to allow for connection of the induction system to a 300 cubic inch engine in a airline baggage tow tractor without having to modify the hood of tractor.

The air intake hose defines an air passage in connection between an initial and terminal end opening. The initial end opening is in fluid connection with the carburetor adapter. The terminal end is connectable to a conventional air filter.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
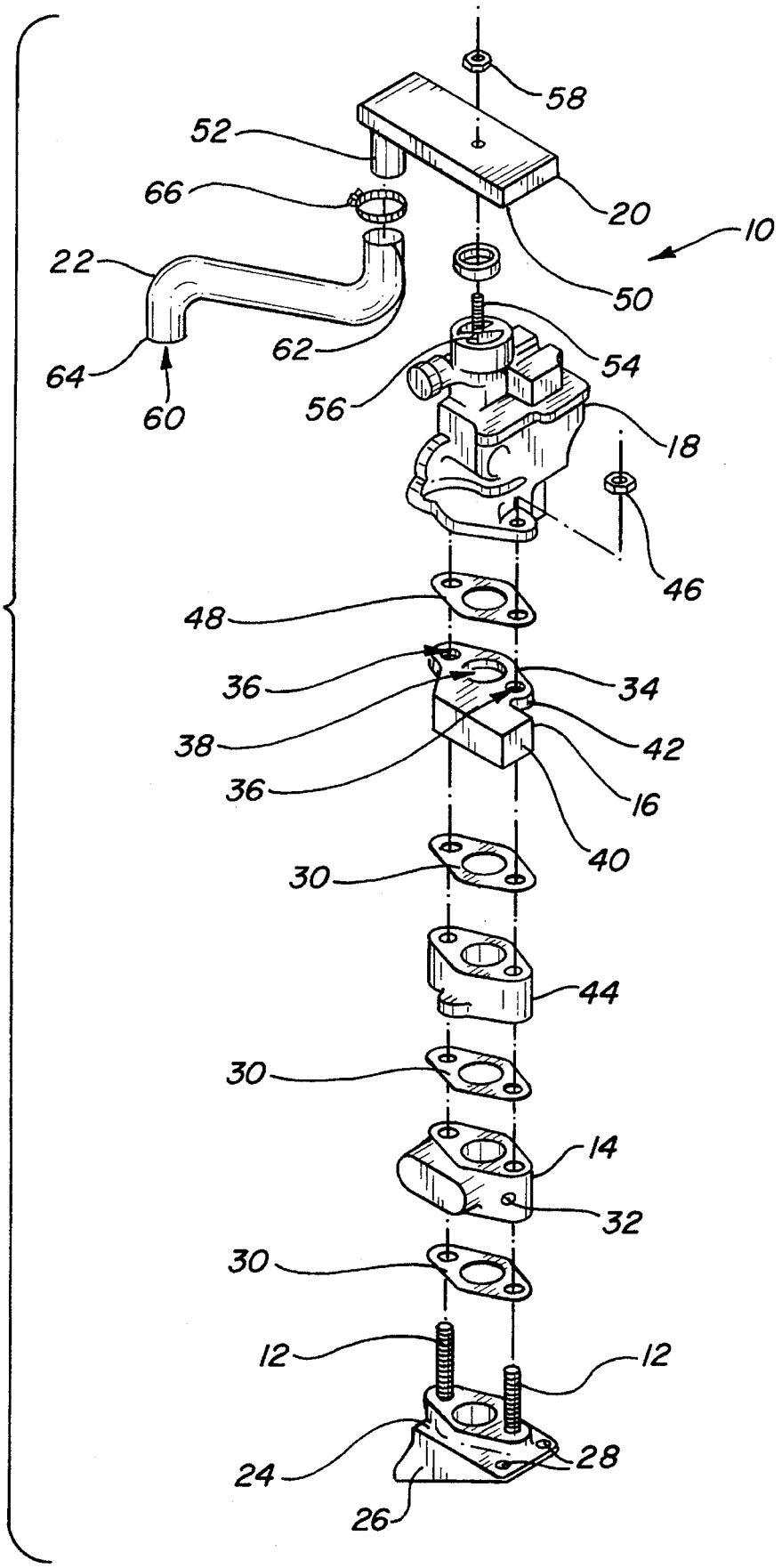
FIG. 1 is a perspective view of an exemplary embodiment of the induction system for a 300 cubic inch Ford/Clark engine of the present invention.

FIG. 1 is a perspective view of an exemplary embodiment of the induction system for a 300 cubic inch Ford/Clark engine of the present invention generally designated by the numeral 10. System 10 includes a governor 14, an governor guard 16, a single barrel, automatic choke carburetor 18, a carburetor adapter 20 and an air intake hose 22.

Studs 12 have external threading and are vertically mounted on a base plate 24. Base plate 24 is sealingly attached to a manifold 26 of a 300 cubic inch Ford/Clark engine (not shown) by grade 8 bolts 28.

A Hoof S372 governor 14 is disposed over studs 12 to form a fluid connection between governor 14 and manifold 26. A Ford D7JL-12A-450-A gasket 30 is entrapped between governor 14 and base plate 24 to form a seal therebetween. An adjustment screw 32 is exposed for adjusting the top speed of the engine.

Governor guard 16 is constructed of stainless steel. Governor guard 16 includes a top planar member 34 forming two stud apertures 36 bracketing a centered fluid pathway 38 and a guard member 40 extending vertically from a first edge 42. Guard member 40 extends four inches below planar member 34 and is two inches in width.

Studs 12 are disposed through stud apertures 36 of governor guard 16 connecting governor guard 16 to governor 14. A pair of Ford D7JL-12A-450-A gaskets 30 and a Ford D9TE-9A589-HA spacer 44 are mounted between governor guard 16 and governor 14 to form a seal therebetween. When governor guard 16 is connected, guard member 40 overlaps and rigidly covers adjustment screw 32, preventing access and tampering with the setting of governor 14.

Carburetor 18 is a Ford D5TZ-9510-AG single barrel, automatic choke carburetor. Studs 12 are disposed through carburetor 18 and nuts 46 are tightly threaded down fluidly connecting carburetor 18 to governor 14. A CG-665 Ford E4TZ-9C477A gasket 48 is entrapped between carburetor 18 and governor guard 16 to form a seal therebetween. When nuts 46 are securely tightened carburetor 18, governor guard 16 and governor 14 are fluidly connected to manifold 26.

Carburetor adaptor 20 is a Tug, Inc. 660-3-0717 carburetor adaptor having an air passageway (not shown) in connection between a first and second port 50,52. A threaded shaft 54 extending vertically from barrel 56 is disposed through first port 50 and carburetor adaptor 20. Carburetor adapter 20 is securely attached to carburetor 18 by threading nut 58 onto shaft 54.

Air intake hose 22 is an three foot long by two-one half inch diameter Everco 1024 hose, having an air passage 60 in connection between an initial and terminal end opening 62,64. Initial end opening 62 is connected to second port 52 of carburetor adapter 20 by two and one-half inch hose clamp 66. Terminal end opening 64 is connectable with a conventional air filter (not shown).

It can be seen from the preceding description that a method and device for enhancing the efficiency and performance of internal combustion engines which incorporates an automatic choke carburetor, includes a governor to prevent excessive engine wear and failures, and prevents tampering and unauthorized adjustment of the governor setting has been provided.

It is noted that the embodiment of the induction system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An induction system for enhancing the efficiency and performance of an internal combustion engine connectable between an air filter and an intake manifold of an internal combustion engine, the induction system comprising:

a governor having an adjustment mechanism, said governor fluidly connectable with said intake manifold;

a governor guard for covering said adjustment mechanism of said governor, said governor guard in connection with said governor;

a carburetor in connection with said governor guard in a manner such that said carburetor is in fluid connection with said governor;

a carburetor adapter forming a air passageway in connection between a first and second port, said first port in fluid connection with said carburetor; and an air intake hose forming a air passage in connection between an initial and terminal end opening, said initial end opening in fluid connection with said second port of said carburetor adapter, said terminal end opening connectable to an air filter.

2. The induction system of claim 1, wherein:

said carburetor has one barrel.

3. The induction system of claim 1, wherein:

said carburetor further includes: an automatic choke.

4. The induction system of claim 1, wherein:

said governor guard further includes:

a guard member adapted for rigidly covering said adjusting mechanism of said governor.

5. The induction system of claim 1, wherein:

said governor guard further includes:

a top planar member in connection with said governor.

6. The induction system of claim 5, wherein:

said top planar member forms a centered fluid pathway therethrough.

7. The induction system of claim 6, wherein:

said governor guard further includes:

a guard member extending substantially vertically from said top planar member, said guard member adapted for rigidly covering said adjusting mechanism of said governor.

8. The induction system of claim 7, wherein:

said guard member extends between three to five inches below said top planar member.

9. The induction system of claim 8, wherein:

said guard member is between one to three inches wide.

10. An induction system connectable between an air filter and an intake manifold of an internal combustion engine, the induction system comprising:

a governor having an adjustment mechanism, said governor fluidly connectable with said intake manifold;

a governor guard having a top planar member and a guard member extending substantially vertically therefrom, said top planar member in connection with said governor, said guard member adapted for rigidly covering said adjusting mechanism of said governor;

a carburetor in connection with said governor guard in a manner such that said carburetor is in fluid connection with said governor;

a carburetor adapter forming a air passageway in connection between a first and second port, said first port in fluid connection with said carburetor; and an air intake hose forming a air passage in connection between an initial and terminal end opening, said initial end opening in fluid connection with said second port of said carburetor adapter, said terminal end opening connectable to an air filter.

11. The induction system of claim 10, wherein:

said top planar member forms a centered fluid pathway therethrough.

12. The induction system of claim 10, wherein:

said guard member extends between three to five inches below said top planar member.

13. The induction system of claim 12, wherein:

said guard member is between one to three inches wide.

14. The induction system of claim 13, wherein:

said top planar member forms a centered fluid pathway therethrough.

15. The induction system of claim 10, wherein:

said carburetor has one barrel.

16. The induction system of claim 10, wherein:

said carburetor further includes:

an automatic choke.

17. The induction system of claim 14, wherein:

said carburetor further includes:

an automatic choke.

18. The induction system of claim 17, wherein:

said carburetor has one barrel.

19. A method for enhancing the efficiency and performance of an internal combustion engine, the method comprising the steps of:

fluidly connecting to an intake manifold of said engine a governor having an adjustment mechanism;

connecting to said governor a governor guard having a guard member adapted for rigidly covering said adjusting mechanism of said governor;

connecting to said governor guard a carburetor, said carburetor being in fluid connection with said governor;

connecting to at least one barrel of said carburetor a first port of a carburetor adapter, said carburetor adapter forming a air passageway in connection between a first and second port; and connecting to said second port of said carburetor adapter an initial end opening of an air intake hose, said air intake hose forming an air passage in connection between an initial and terminal end opening, said terminal end opening connectable to an air filter.

20. The method of claim 17 further comprising the step of:

connecting to said carburetor an automatic choke.

* * * * *